US007931349B2

(12) United States Patent
Hatada et al.

(10) Patent No.: US 7,931,349 B2
(45) Date of Patent: Apr. 26, 2011

(54) LIQUID EJECTING APPARATUS

(75) Inventors: Kenji Hatada, Shiojiri (JP); Hitoshi Igarashi, Shiojiri (JP); Koji Niioka, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 408 days.

(21) Appl. No.: 12/231,339

(22) Filed: Sep. 2, 2008

(65) Prior Publication Data

US 2009/0060559 A1 Mar. 5, 2009

(30) Foreign Application Priority Data

Aug. 31, 2007 (JP) ..... 2007-225316

(51) Int. Cl.
*B41J 29/393* (2006.01)
*B41J 3/407* (2006.01)

(52) U.S. Cl. ..... 347/19; 347/106

(58) Field of Classification Search ..... 347/19, 347/106

See application file for complete search history.

(56) References Cited

U.S. PATENT DOCUMENTS 5,834,857 A * 11/1998 Abe et al. ..... 307/66
6,194,698 B1 * 2/2001 Zavislan et al. ..... 250/214 A
6,508,552 B1 * 1/2003 Steinfield et al. ..... 347/102
6,869,241 B2 * 3/2005 Ouchi et al. ..... 400/578
2006/0023047 A1 * 2/2006 Green ..... 347/104

FOREIGN PATENT DOCUMENTS

| | | | |
|---|---|---|---|
| JP | 2-171260 | * | 7/1990 |
| JP | 2005-111681 | | 4/2005 |
| JP | 2007-276134 | | 10/2007 |
| JP | 2007-276135 | | 10/2007 |
| JP | 2007-276888 | | 10/2007 |
| JP | 2008-68936 | | 3/2008 |
| JP | 2008-068952 | | 3/2008 |

* cited by examiner

*Primary Examiner* — Julian D Huffman
(74) *Attorney, Agent, or Firm* — Nutter McClennen & Fish LLP; John J. Penny, V

(57) ABSTRACT

A liquid ejecting apparatus includes a record head having nozzles that discharge liquid; a transporting path along which a medium is transported; a transporting mechanism that transports the medium along the transporting path; a sensor including a light-emitting element and a light-receiving element and disposed at a first position on the transporting path, the first position being located upstream relative to the record head in a transporting direction of the medium, the sensor outputting a signal in accordance with presence or absence of the medium at the first position; and a control unit that controls supply of power to the sensor and detects the presence or absence of the medium through the sensor. The control unit stops the supply of power to the sensor when the control unit detects a downstream end of the medium in the transporting direction, and resumes the supply of power to the sensor when the control unit detects an upstream end of the medium in the transporting direction.

7 Claims, 6 Drawing Sheets

LIQUID EJECTING APPARATUS

BACKGROUND

1. Technical Field

The present invention relates to liquid ejecting apparatuses.

2. Related Art

Large-sized ink jet printers intended for commercial use that can record images onto cut paper, continuous paper, or rolled paper having a large size such as A0, A1, or A2 size have become widely used in recent years. In addition, there have been proposed various technologies for enhancing the convenience of such printers. For example, JP-A-2005-111681 discloses a technology for preventing misalignment of the recording position with high accuracy, which can occur when recording an image onto continuous paper stored in a zigzag-folded manner in a paper tray.

Like other types of printers, large-sized commercial-use ink jet printers are equipped with a photo-interrupter as a paper-end detecting sensor. A photo-interrupter is generally configured to emit light continuously towards an end-detection position, which is located on a paper-transporting path extending from a paper tray to a record head and is slightly closer towards the paper tray relative to the record head. Based on a change in the intensity of the reflection of the light, the photo-interrupter detects whether or not the leading end and the trailing end of the paper have passed the end-detection position. The detection signal of the photo-interrupter is used as a basis for determining a paper transporting distance based on which the paper is transported below the record head.

However, unlike the so-called small-sized printers intended for consumer use, large-sized commercial-use printers are often used while being kept turned on over an extended period time. This can mean that the photo-interrupter would continuously emit light even while image recording is not being performed, causing the photo-interrupter to deteriorate faster than that in a small-sized printer.

SUMMARY

An advantage of some aspects of the invention is that a mechanism that can minimize deterioration of a photo-interrupter used in a large-sized commercial-use printer is provided.

According to a first aspect of the invention, a liquid ejecting apparatus includes a record head having nozzles that discharge liquid; a transporting path along which a medium is transported; a transporting mechanism that transports the medium along the transporting path; a sensor including a light-emitting element and a light-receiving element and disposed at a first position on the transporting path, the first position being located upstream relative to the record head in a transporting direction of the medium, the sensor outputting a signal in accordance with presence or absence of the medium at the first position; and a control unit that controls supply of power to the sensor and detects the presence or absence of the medium through the sensor. The control unit stops the supply of power to the sensor when the control unit detects a downstream end of the medium in the transporting direction, and resumes the supply of power to the sensor when the control unit detects an upstream end of the medium in the transporting direction. Accordingly, the power consumption and deterioration of the sensor can be minimized, while the trailing end of the medium can be properly detected when it reaches the first position.

According to a second aspect of the invention, a liquid ejecting apparatus includes a record head having nozzles that discharge liquid; a transporting path along which a medium is transported; an image obtaining unit that obtains an image signal designating an image; a transporting mechanism that intermittently transports the medium along the transporting path; a sensor including a light-emitting element and a light-receiving element and disposed at a first position on the transporting path, the first position being located upstream relative to the record head in a transporting direction of the medium, the sensor outputting a signal in accordance with presence or absence of the medium at the first position; and a control unit that controls supply of power to the sensor and detects the presence or absence of the medium through the sensor. The control unit stops the supply of power to the sensor when the control unit detects that a downstream end of the medium in the transporting direction has reached the first position, allows the medium to be transported intermittently by a predetermined number of times determined based on the image signal, and resumes the supply of power to the sensor before an upstream end of the medium in the transporting direction reaches the first position. Accordingly, the power consumption and deterioration of the sensor can be minimized, while the leading and trailing ends of the medium can be properly detected when they reach the first position.

The control unit may determine a position of the upstream end of the medium when the control unit detects the upstream end of the medium, and may designate a section located downstream from the upstream end by a predetermined distance as a recording position for a downstream frame line in the transporting direction to be recorded on the medium, the downstream frame line being one of a plurality of frame lines to be recorded on the medium, the frame lines corresponding to edges of the medium. Accordingly, a ruled line can be properly recorded along a rendering-image denotation section located forward of the upstream end of the medium by a predetermined distance, whereby printed paper that satisfies the specifications required in, for example, a CAD drawing can be readily obtained.

After the control unit detects the downstream end of the medium, the control unit may supply power to the sensor while the medium is transported by the transporting mechanism, but may stop the supply of power to the sensor while the transporting of the medium is stopped. Accordingly, the power consumption and deterioration of the sensor can be minimized more effectively.

The control unit may adjust an amount of power supplied to the light-emitting element on the basis of an output level of a signal output from the light-receiving element when the medium is present at the first position. Accordingly, the intensity of light emitted from the light-emitting element can be adjusted to a level required and sufficient for the detection of the medium, thereby minimizing the power consumption of the light-emitting element.

The control unit may determine whether the output level of the signal is within a predetermined range between a permissible upper-limit value and a permissible lower-limit value, and may increase or decrease the amount of power supplied to the light-emitting element so as to adjust the output level of the signal to within the predetermined range. Accordingly, the intensity of light required and sufficient for the detection of the medium can be determined with high accuracy.

The liquid ejecting apparatus may be capable of performing recording on a medium having an A0, A1, or A2 size. Accordingly, the advantages regarding the minimization of the power consumption and deterioration of the sensor can be exhibited to the utmost effect.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of the invention will now be described with reference to the drawings.

Figure 1:
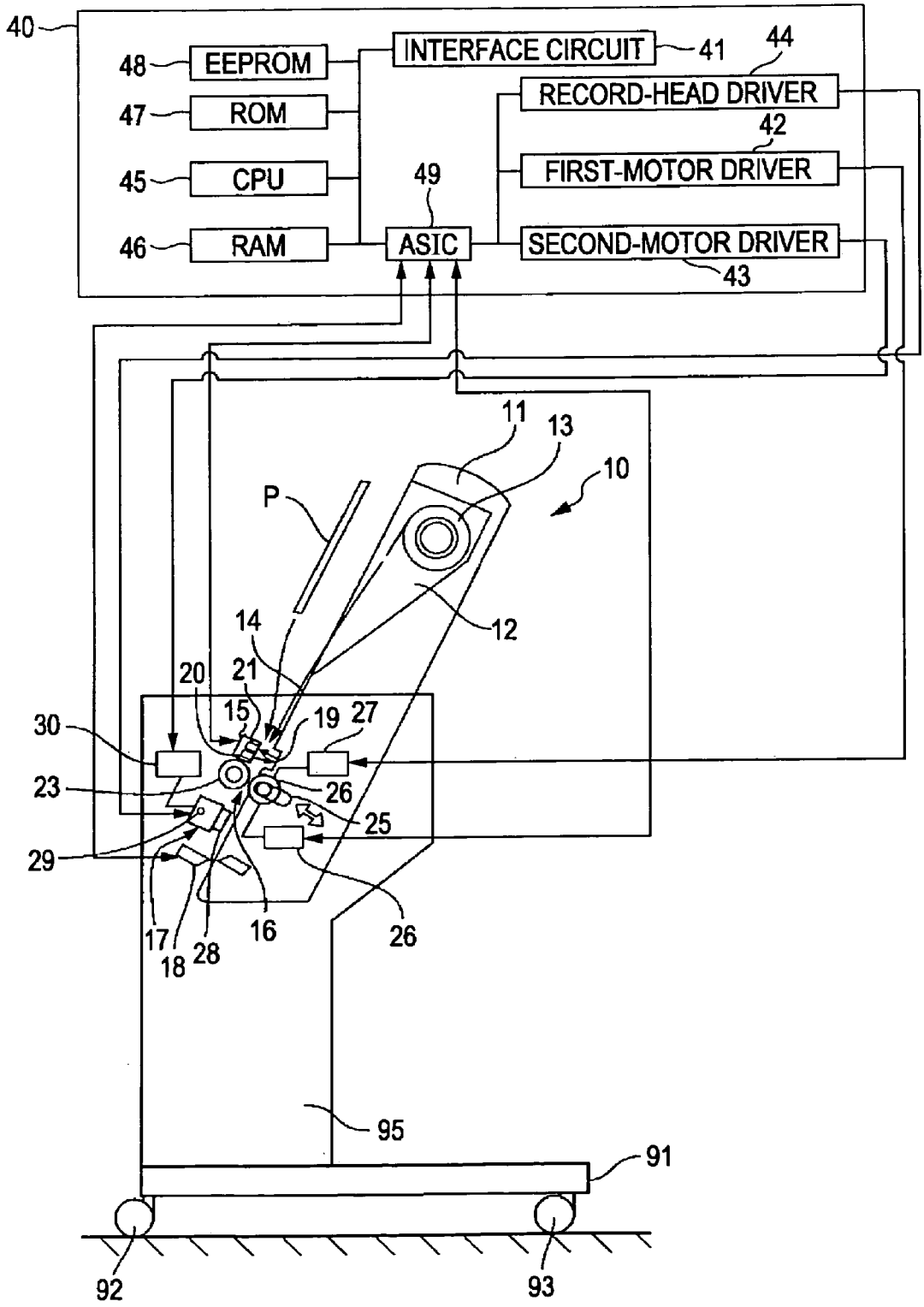
FIG. 1 schematically illustrates an ink jet printer according to an exemplary embodiment of the invention.

FIG. 1 schematically illustrates an ink jet printer according to an exemplary embodiment of the invention. Specifically, the upper part of FIG. 1 is a block diagram showing an electrical configuration of the printer and the lower part of FIG. 1 is a right side view showing a mechanical configuration of the printer. In FIG. 1, the left and right sides of the drawing correspond to the front and rear sides of the printer, respectively.

Referring to FIG. 1, the printer is mechanically constructed such that wheels 92 and 93 are attached to four corners of the lower surface of a flat base 91 and that two leg frames 95 extending upward respectively from left and right edges of the upper surface of the base 91 support a printing unit 10 from the left and right sides thereof. The printing unit 10 has a rectangular parallelepiped housing 11 with a slit at the bottom surface thereof, the slit being formed by cutting off a bottom section of the rectangular parallelepiped from the front edge of the bottom surface along a line extending parallel to the ground. The housing 11 is held between the leg frames 95 while the upper surface of the housing 11 is slanted slightly rearward. A hollow section 12 with an opening that faces forward is provided at an upper section of the housing 11. The hollow section 12 has rolled paper 13 fitted therein. A paper-transporting path 14 is formed at a section on the front surface of the housing 11 that is located below the hollow section 12. The paper-transporting path 14 has a start point and an end point between which a paper-end detecting sensor 15 (corresponding to part of a detecting unit), a pair of paper feed (PF) rollers 16 (corresponding to part of a transporting mechanism), a carriage 17 (corresponding to part of an ejecting unit), and a rotary cutter 18 are arranged. In the description hereinafter, a side of the paper-transporting path 14 proximate to the hollow section 12 will be referred to as an "upstream side", and a side of the paper-transporting path 14 distant from the hollow section 12 will be referred to as a "downstream side".

The printer can operate under two modes, i.e. a rolled-paper print mode in which printing is performed by sending the rolled paper 13 fitted in the hollow section 12 towards the paper-transporting path 14 and a cut-paper print mode in which printing is performed by allowing the user to insert cut paper P (corresponding to a medium) cut into A0, A1, A2 size, etc. in a one-by-one fashion into the paper-transporting path 14. In the description hereinafter, the cut paper P and the rolled paper 13 will collectively be referred to as "paper".

The paper-end detecting sensor 15 is defined by a reflective photo-interrupter that includes a light-emitting element 20 and a light-receiving element 21. Specifically, the light-emitting element 20 is arranged to emit light towards a recess 19 located slightly below the opening of the hollow section 12, and the light-receiving element 21 is arranged to receive the light from the recess 19. The intensity of light emitted from the light-emitting element 20 towards the recess 19 is proportional to the magnitude of electric current flowing into the light-emitting element 20 from a power source (not shown). The light-receiving element 21 photo-electrically converts the light received from the recess 19 to a signal and sends the signal to a control unit 40. The voltage of the signal increases as the intensity of light received by the light-receiving element 21 increases. Accordingly, the paper-end detecting sensor 15 can determine the passing of the leading end of paper when the voltage of the signal output from the light-receiving element 21 falls below a preset threshold value, and can also determine the passing of the trailing end of paper when the voltage of the signal exceeds the threshold value.

The pair of PF rollers 16 include a driven PF roller 23 and a driving PF roller 24. The left and right ends of a rotary shaft for the driven PF roller 23 are respectively secured to holes provided in the two leg frames 95. These holes are located downstream of the paper-end detecting sensor 15 and slightly forward of the front surface of the housing 11. On the other hand, the left and right ends of a rotary shaft for the driving PF roller 24 are respectively fitted to rails 25 provided in the two leg frames 95. Each of these rails 25 is located downstream of the paper-end detecting sensor 15 and extends from a position slightly rearward of the front surface of the housing 11 towards the rear surface of the housing 11. Each rail 25 has a front end and a rear end that are separated from each other by a distance that is larger than the diameter of the rotary shaft for the driving PF roller 24. In other words, the rails 25 allow a slight play for the movement of the driving PF roller 24 therein, such that the driving PF roller 24 is slidable between a position where the periphery of the driving PF roller 24 contacts the periphery of the driven PF roller 23 and a position where the two PF rollers 23 and 24 are completed spaced apart from each other.

The driving PF roller 24 is supported by an actuator 26, and the rotary shaft of the driving PF roller 24 is linked to a rotary shaft of a PF motor 27 (corresponding to part of the transporting mechanism) via a plurality of gears (not shown). When the passing of the leading end of the rolled paper 13 or cut paper P is detected, the actuator 26 moves the driving PF roller 24 toward the driven PF roller 23. On the other hand, when the passing of the trailing end is detected, the actuator 26 moves the driving PF roller 24 away from the driven PF roller 23. The PF motor 27, controlled by the control unit 40, rotates the driving PF roller 24 counterclockwise. When the printer is to be operated under the rolled-paper print mode, it is necessary to perform a preparation process for sliding the rolled paper 13 through a position between the paper-end detecting sensor 15 and the recess 19 (from hereinafter referred to as an "end-detection position" corresponding to a "first position") so as to insert the leading end of the rolled paper 13 into between the two PF rollers 16. On the other hand, when the printer is to be operated under the cut-paper print mode, it is necessary to perform a preparation process for sliding the cut paper P through the end-detection position so as to insert the leading end of the cut paper P into between the two PF rollers 16. When the passing of the leading end of the paper through the end-detection position as the result of the preparation process is detected, the actuator 26 moves the driving PF roller 24 towards the driven PF roller 23, causing the leading end of the paper to become nipped between the two rollers. While the leading end of the paper is kept in this nipped state, the driving PF roller 24 rotates so as to transport the paper downstream.

The carriage 17 disposed downstream of the pair of PF rollers 16 accommodates ink cartridges for the four colors, yellow (Y), magenta (M), cyan (C), and black (B), and is equipped with a record head 28 at the paper-transporting path 14 side, the record head 28 being connected to the ink cartridges via flow channels (not shown). The record head 28 includes, for example, a nozzle plate having arranged thereon arrays of nozzles for the respective colors, a piezoelectric element that contracts and expands in accordance with charge and discharge operations, and a cavity located between the nozzle plate and the piezoelectric element. When the piezoelectric element contracts or expands in a state where the ink supplied from the corresponding ink cartridge is retained in the cavity, ink droplets become ejected from the nozzles toward the paper-transporting path 14.

The carriage 17 has holes provided in the right and left surfaces thereof. A guide shaft 29 bridged between the leg frames 95 extend through these holes, such that the carriage 17 is slidably linked to the guide shaft 29. The carriage 17 is secured to a part of a belt (not shown), which is wound between two pulleys (not shown) and extended in a direction substantially parallel to the guide shaft 29. A rotary shaft for one of these pulleys is linked to a rotary shaft of a carriage (CR) motor 30. Consequently, when the CR motor 30 rotates in forward and reverse directions, the carriage 17 is moved back and forth between the left edge of the paper-transporting path 14 (which will be referred to as a "left-movement limit position" hereinafter) and the right edge of the paper-transporting path 14 (which will be referred to as a "right-movement limit position" hereinafter) while being guided by the guide shaft 29. The rotary cutter 18 disposed downstream of the carriage 17 is configured to cut the paper at a timing designated by the control unit 40.

Referring to FIG. 1, the control unit 40 (corresponding to part of the detecting unit and to a power supplying unit) includes an interface circuit 41 (corresponding to an image obtaining unit), a first-motor driver 42, a second-motor driver 43, a record-head driver 44, a central processing unit (CPU) 45, a random access memory (RAM) 46, a read-only memory (ROM) 47, an electrically erasable programmable read-only memory (EEPROM) 48, and an application specific integrated circuit (ASIC) 49.

The interface circuit 41 receives print data designating the content of an image to be rendered, such as an A0, A1, or A2 sized image, from a personal computer (not shown), and also receives selected-mode data designating the print mode selected through a customization screen in the personal computer. On this customization screen, one of the modes related to the desired paper feeding method can be selected from the aforementioned rolled-paper print mode and cut-paper print mode, and moreover, one of modes related to the desired print quality can be selected from a default mode and a photo mode. A photo mode may be selected for recording the dots of an image with higher density than under the default mode. This photo mode is suitable for the output of print data containing a high-density color image, such as a photographic image. The record-head driver 44 sends a signal to the record head 28 for commanding the record head 28 to eject ink droplets on the basis of the content contained in the print data.

The first-motor driver 42 receives a direct-current voltage from a power source (not shown) and applies the direct-current voltage to the PF motor 27 as a pulse based on a pulse width modulation (PWM) signal. A PWM signal has a rectangular wave with constant cycles and with a variable ratio between a high-pulse-level time period and a low-pulse-level time period that occupy each cycle. The percentage of a high-pulse-level time period of a PWM signal relative to the total time period in each cycle is called a duty ratio. The PF motor 27 rotates in response to the pulse received from the first-motor driver 42, and the torque for the rotation of the PF motor 27 increases as the duty ratio becomes higher.

The second-motor driver 43 has the same configuration as the first-motor driver 42. Specifically, the second-motor driver 43 receives a direct-current voltage from a power source (not shown) and applies the direct-current voltage to the CR motor 30 as a pulse based on a PWM signal received by the second-motor driver 43 itself. The CR motor 30 rotates in response to the pulse received from the second-motor driver 43, and the torque for the rotation of the CR motor 30 increases as the duty ratio becomes higher.

The CPU 45 uses the RAM 46 as a work area and refers to data stored in the ROM 47 and the EEPROM 48 as well as executing various programs stored in these memories. In the ROM 47, relatively simple programs such as an initial program loader (IPL) are stored. On the other hand, the EEPROM 48 stores a control program that designates a control procedure to be performed from the point when the print data is supplied to the interface circuit 41 to the point when the image contained in the print data is recorded. The ASIC 49 has input and output ports that are connected to the paper-end detecting sensor 15, the rotary cutter 18, the first-motor driver 42, the second-motor driver 43, and the record-head driver 44, and exchanges signals therewith by being controlled by the CPU 45.

The CPU 45 intermittently drives the PF motor 27 and the CR motor 30 in synchronization with each other and causes the record head 28 to eject ink droplets synchronously with the driving of the CR motor 30, whereby the image contained in the print data is recorded onto the paper.

Figure 2:
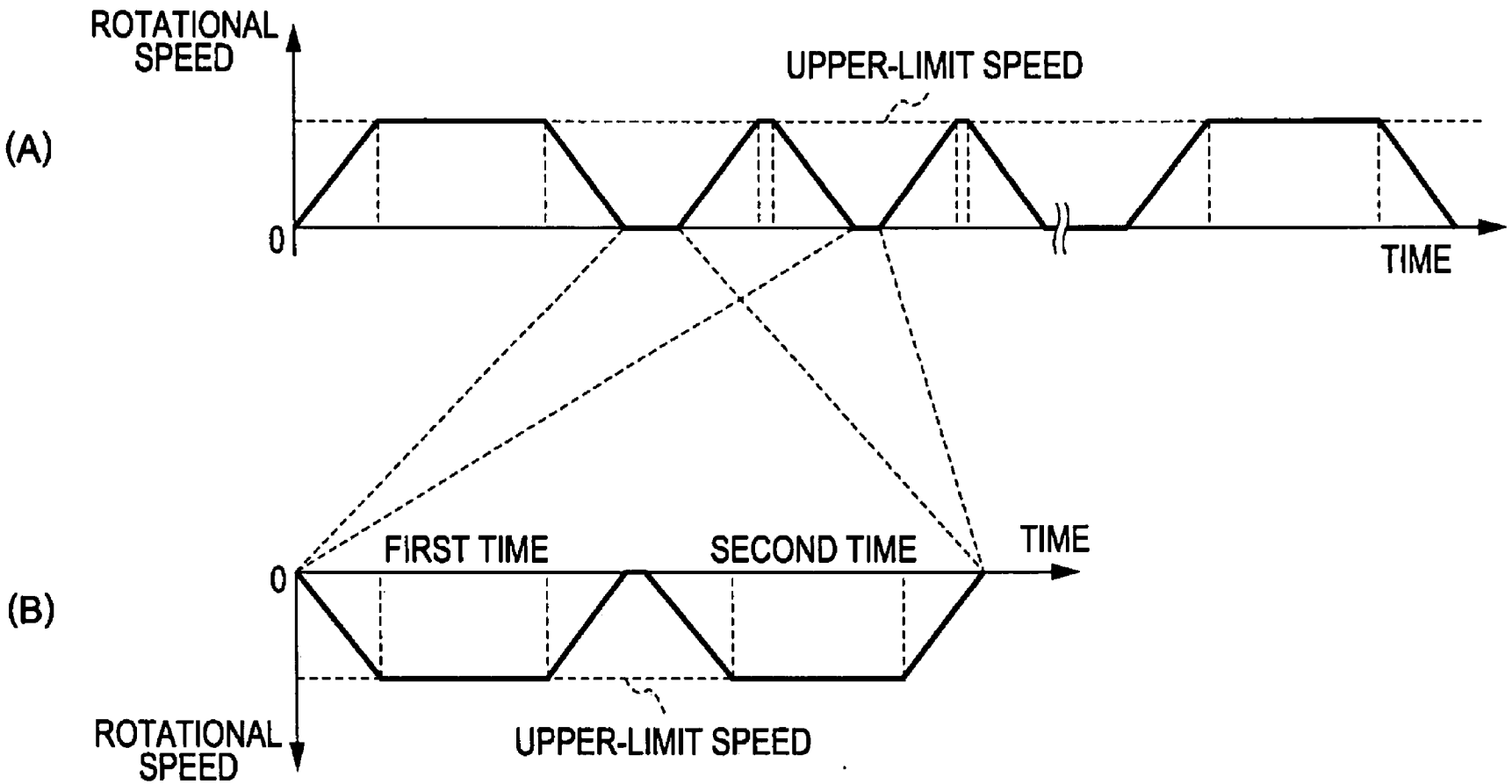
FIG. 2 shows a state where a PF motor and a CR motor are driven in a cooperative manner.

FIG. 2 includes part (A) and part (B) showing a state where the motors 27 and 30 are driven in a cooperative manner when a single image contained in print data is being recorded on paper. The ordinate axis in part (A) and part (B) indicates the rotational speed of the motors 27 and 30, whereas the abscissa axis indicates the driving time of the motors 27 and 30. For the sake of convenience, the abscissa axis in part (B) of FIG. 2 is shown at a smaller scale than that in part (A) of FIG. 2, and the ordinate axis in part (B) of FIG. 2 is oriented in the opposite direction relative to that in part (A) of FIG. 2.

In the state where the leading end of paper is nipped between the driving PF roller 24 and the driven PF roller 23 as the result of the aforementioned preparation process, when print data designating the content of an image to be rendered is supplied from a personal computer in this state, the PF motor 27 previously in a non-rotative state (speed=0) is accelerated in a substantially proportional manner until the rotational speed thereof reaches a predetermined upper-limit speed as shown in part (A) of FIG. 2. The PF motor 27 accelerated to the upper-limit speed continues to rotate at that rotational speed for some time, but is subsequently decelerated in a substantially proportional manner until the PF motor 27 is brought back to the non-rotative state. According to a series of these rotations of the PF motor 27, the paper nipped between the two rollers 24 and 23 is transported downstream until a section on the paper located rearward of the leading end thereof by a distance corresponding to the margin of the paper reaches a position where the section receives ink droplets ejected from the record head 28 (such a position will hereinafter be referred to as an "ink-droplet ejecting position" corresponding to a "second position").

As the PF motor 27 is brought back to the non-rotative state and the transporting of the paper stops, the CR motor 30 is accelerated in a substantially proportional manner until the rotational speed thereof reaches a predetermined upper-limit speed as shown in part (B) of FIG. 2. The CR motor 30 continues to rotate at that rotational speed for some time, but is subsequently decelerated in a substantially proportional manner until the CR motor 30 is brought back to the non-rotative state. According to a series of these rotations of the CR motor 30, the carriage 17 is moved from the left-movement limit position toward the right-movement limit position. In addition, while the carriage 17 is moved from the left-movement limit position toward the right-movement limit position at the upper-limit speed, the record head 28 ejects ink droplets toward the paper so as to record an array of dots corresponding to one line of the image in the main scanning direction.

Referring to part (B) in FIG. 2, the CR motor 30 is rotated twice repetitively during the time when the transporting of the paper is stopped (corresponding to an interval). The second rotation of the CR motor 30 is oriented in the opposite direction from that of the first rotation. Due to the second rotation of the CR motor 30, the carriage 17 previously moved to the right-movement limit position is subsequently moved towards the left-movement limit position. Whether or not ink droplets are to be ejected while the carriage 17 is being moved from the right-movement limit position back to the left-movement limit position depends on various customized information set via the customization screen.

When the carriage 17 returns to the left-movement limit position, the PF motor 27 previously in the non-rotative state is accelerated in a substantially proportional manner until the rotational speed thereof reaches the upper-limit speed. The PF motor 27 continues to rotate at that rotational speed for some time, but is subsequently decelerated in a substantially proportional manner until the PF motor 27 is brought back to the non-rotative state (see part (A) in FIG. 2). According to a series of these rotations of the PF motor 27, the paper is transported downstream by a distance corresponding to one line of the image in the sub scanning direction. In other words, this distance corresponding to one line corresponds to a paper transporting distance which is determined on the basis of the relationship between the size of the image contained in the print data and the mode related to the desired print quality. If the photo mode is selected, the dots are recorded with ink droplets at high density, which means that the paper transporting distance becomes shorter than that for the default mode.

Subsequently, the CR motor 30 and the PF motor 27 are rotated alternately until all arrays of dots corresponding to all of the lines of the image in the sub scanning direction are recorded. This means that the reciprocal movement of the carriage 17 between the left-movement limit position and the right-movement limit position and the transporting of the paper by the distance corresponding to one line in the sub scanning direction are repeated in accordance with the alternate rotations of the CR motor 30 and the PF motor 27. The number of times the reciprocal movement of the carriage 17 and the transporting of the paper by the distance corresponding to one line are repeated is also determined on the basis of the relationship between the size of the image contained in the print data and the mode related to the desired print quality. When an array of dots corresponding to the bottommost line of the image in the sub scanning direction is recorded onto the paper, the PF motor 27 previously in the non-rotative state rotates so as to transport the paper with the image recorded thereon in the downstream direction. As a result, the paper is discharged from the printer. In the case where the recording of the image is performed under the rolled-paper print mode, the rolled paper 13 is cut by the rotary cutter 18 before being discharged from the printer. On the other hand, in the case where the recording of the image is performed under the cut-paper print mode, the cut paper P is discharged from the printer without undergoing such a cutting process.

Next, a cut-paper computer-aided-design (CAD) printing process and a sensor-luminance adjusting process, which are characteristic processes of this embodiment, will be described below.

Cut-Paper CAD Printing Process

Figure 3:
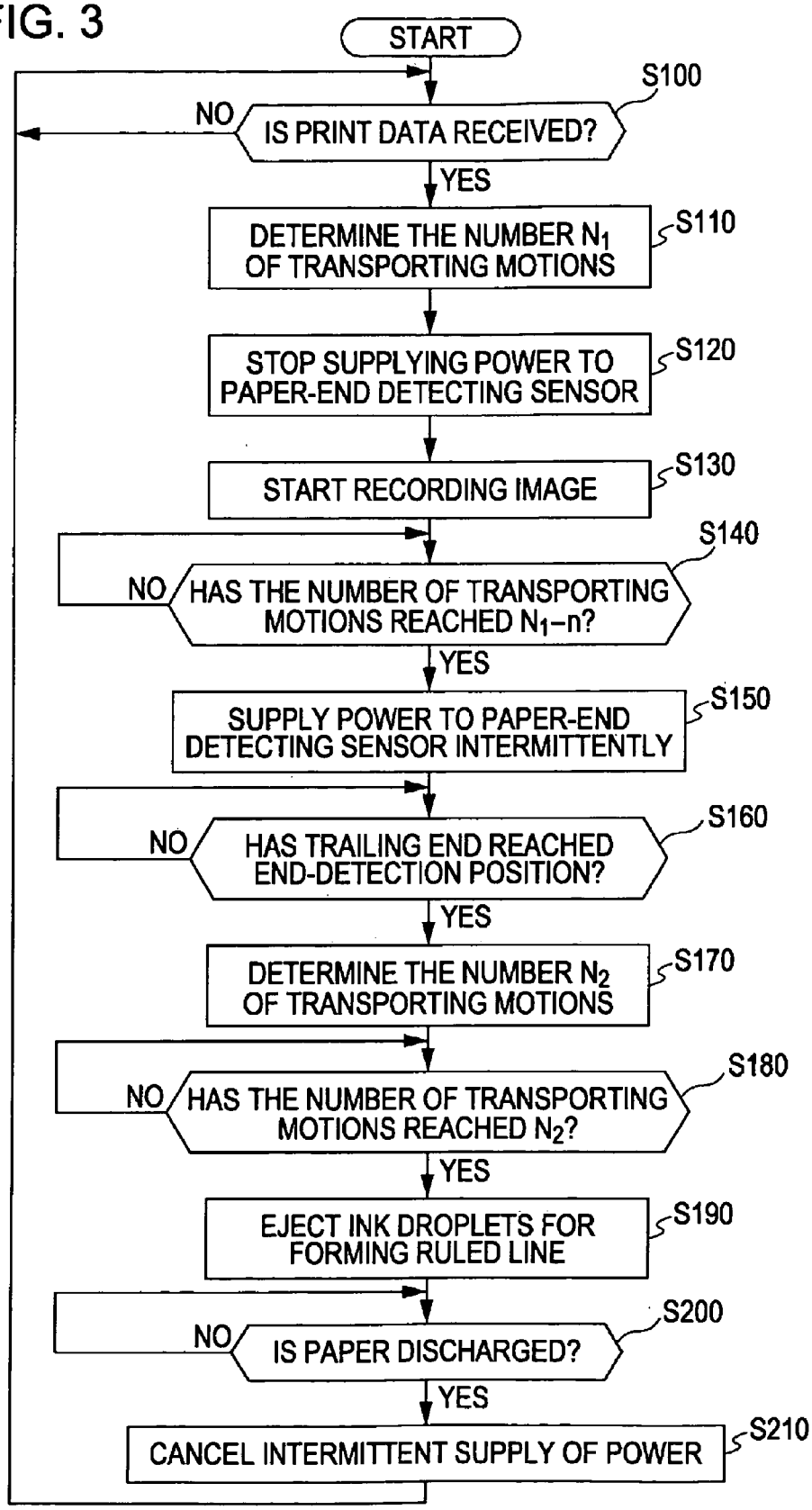
FIG. 3 is a flow chart of a cut-paper CAD printing process.

FIG. 3 is a flow chart of a cut-paper CAD printing process. Specifically, a cut-paper CAD printing process involves recording an image of a CAD drawing contained in print data onto cut paper P, forming a margin with a predetermined width measured from the trailing end of the cut paper P towards the leading end to satisfy the specifications of the CAD drawing, and recording a ruled line along a section that divides the margin and the denotation of the CAD drawing, which is an image to be rendered (such a section will be referred to as a "rendering-image denotation section" hereinafter).

The process shown in FIG. 3 is executed when print data containing an image of a CAD drawing is received from a personal computer in a state where the leading end of cut paper P is nipped between the driving PF roller 24 and the driven PF roller 23. In the preparation process prior to the reception of the print data, the user must slide the cut paper P having the same size (A0, A1, or A2) as the image contained in the print data through the end-detection position so as to insert the leading end of the cut paper P into between the two PF rollers 16.

When the print data is received from the personal computer (YES in step S100), the control unit 40 determines in step S110 the number $N_1$ of times the cut paper P would need to be transported downstream intermittently (sometimes referred to as "the number of transporting motions" hereinafter) before the rendering-image denotation section on the cut paper P can reach the end-detection position. The number $N_1$ can be estimated on the basis of the relationships among the distance in the sub scanning direction between the leading end of the cut paper P and the rendering-image denotation section, the size of the image contained in the print data, and the mode related to the desired print quality. However, because the cut paper P to be transported in the printer according to this embodiment is an A0, A1, or A2 sized paper and thus has a large length in the sub scanning direction, the paper transporting distance may slightly vary every time the PF motor 27 is driven. Due to accumulation of these slight variations in the paper transporting distance, the rendering-image denotation section may possibly become somewhat misaligned with the end-detection position towards the downstream side or the upstream side after completion of $N_1$ transporting motions.

Subsequently, the control unit 40 stops the supply of power to the paper-end detecting sensor 15 in step S120 and starts recording the image contained in the print data in step S130. Once the supply of power to the paper-end detecting sensor 15 stops, the emission of light towards the end-detection position also stops. When the image recording operation starts, the PF motor 27, the CR motor 30, and the record head 28 are driven intermittently in synchronization with one another in accordance with the procedure shown in FIG. 2. Consequently, the cut paper P is transported downstream along the paper-transporting path 14 in a stepwise fashion by a distance corresponding to one line of the image in the sub scanning direction, whereby an array of dots corresponding to one line in the main scanning direction is recorded onto the cut paper P on an array-by-array basis.

After the start of the image recording operation, the control unit 40 counts the number of times the cut paper P is transported by the PF motor 27 and determines in step S140 whether the counted number has reached a number $N_1-n$ obtained by subtracting a predetermined offset value n from the number $N_1$ determined in step S110. The offset value n is for compensating for upstream shifting of the paper transporting distance occurring as a result of the driving of the PF motor 27, and is set on the basis of operational test results obtained prior to shipment of the printer. This offset value n must ensure that the rendering-image denotation section on the cut paper P will be located downstream relative to the end-detection position at the time of completion of $N_1-n$ transporting motions regardless of variations in the paper transporting distance.

When it is determined in step S140 that the number of times the cut paper P is transported has reached $N_1-n$ (YES in step S140), the control unit 40 intermittently supplies power to the paper-end detecting sensor 15 in synchronization with the transporting of the cut paper P by the PF motor 27 in step S150. From step S150 onward, the current value of the power supplied to the paper-end detecting sensor 15 is optimized through a sensor-luminance adjusting process to be described later. As the paper-end detecting sensor 15 receives power intermittently, the paper-end detecting sensor 15 emits light toward the end-detection position only during the period in which the cut paper P is being moved along the paper-transporting path 14 by the PF motor 27. Consequently, until the trailing end of the cut paper P reaches the end-detection position through one or more subsequent transporting motions, the light emitted from the light-emitting element 20 is reflected by the cut paper P and then received by the light-receiving element 21. The control unit 40 compares the voltage of a signal sent from the light-receiving element 21 to the ASIC 49 with a preset threshold value. When the voltage exceeds the threshold value, the control unit 40 determines that the trailing end of the cut paper P has reached the end-detection position.

When the trailing end of the cut paper P is determined to have reached the end-detection position (YES in step S160), the control unit 40 determines in step S170 the number $N_2$ of times the cut paper P would need to be transported before the rendering-image denotation section located forward of the trailing end by a distance corresponding to the aforementioned margin can reach the ink-droplet ejecting position. The control unit 40 then counts the number of times the cut paper P is transported by the PF motor 27 and determines in step S180 whether the counter number has reached the number $N_2$. The number $N_2$ can be estimated on the basis of the relationship between the distance between the ink-droplet ejecting position and the end-detection position on the paper-transporting path 14 and the paper transporting distance for the cut paper P.

When it is determined in step S180 that the number of times the cut paper P is transported has reached $N_2$ (YES in step S180), the process proceeds to step S190 where the control unit 40 allows the record head 28 to eject ink droplets for forming a ruled line during the next reciprocal movement of the carriage 17. Subsequently, the control nit 40 determines in step S200 whether the cut paper P with the image recorded thereon is discharged from the printer. If the cut paper P is determined to be discharged (YES in step S200), the control unit 40 cancels the intermittent supply of power to the paper-end detecting sensor 15 in step S210, and waits for new cut paper P to be passed through the end-detection position.

Accordingly, the above-described cut-paper CAD printing process allows for reduced power consumption of the paper-end detecting sensor 15 as well as proper recording of a ruled line along the rendering-image denotation section located forward of the trailing end of the cut paper P by a predetermined distance, whereby printed paper that satisfies the specifications required in a CAD drawing can be obtained.

Figure 4:
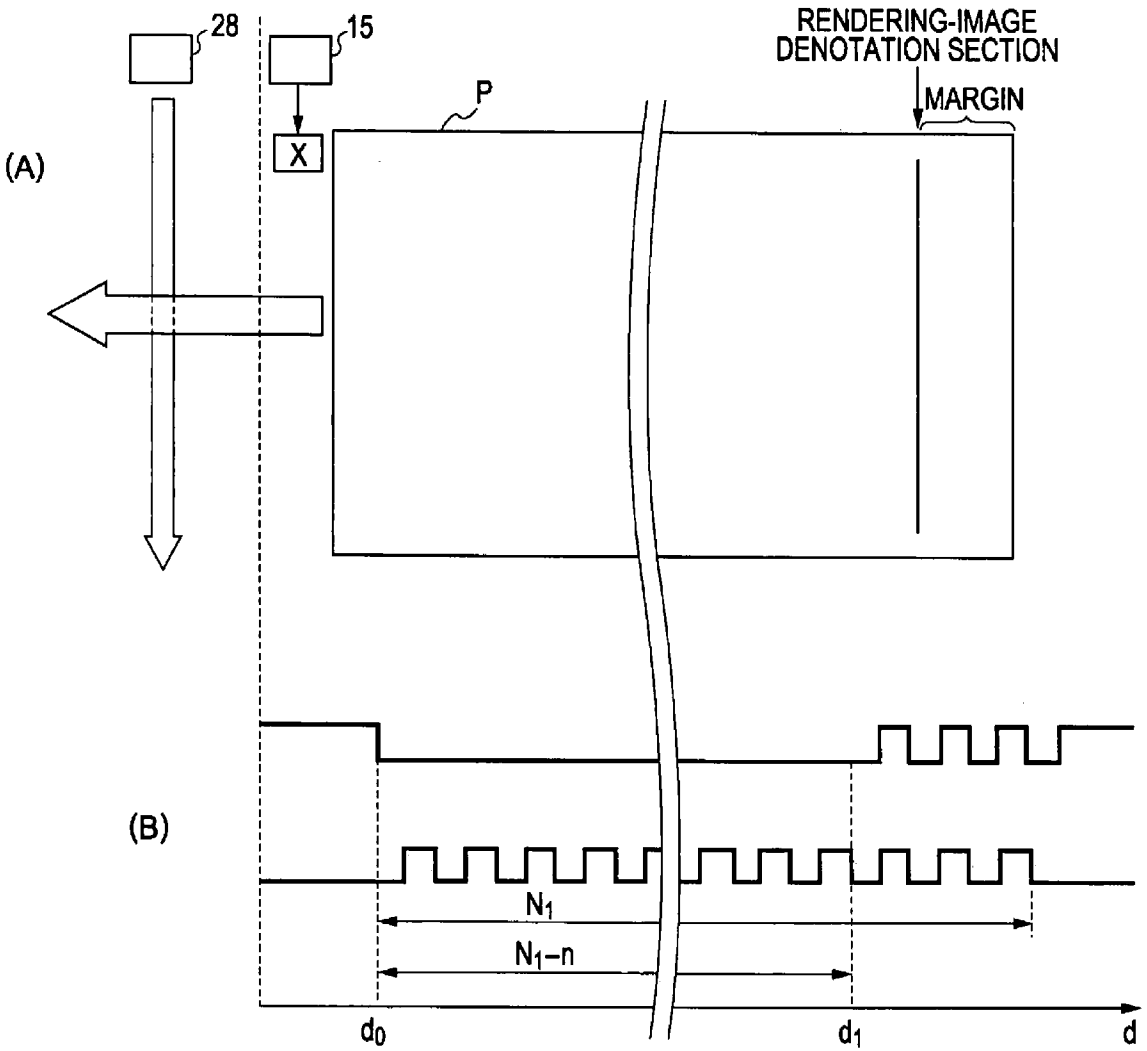
FIG. 4 includes timing charts showing the supply and non-supply of power to a paper-end detecting sensor and intermittent transporting of cut paper by the PF motor.

The principle of this cut-paper CAD printing process will be described in detail below with reference to FIG. 4. FIG. 4. includes part (A) and part (B) which are timing charts showing the supply and non-supply of power to the paper-end detecting sensor 15 and the intermittent transporting of the cut paper P by the PF motor 27. The timing chart in part (A) of FIG. 4 shows a high-level state and a low-level state, the high-level state corresponding to a period during which power is supplied to the paper-end detecting sensor 15 and the low-level state corresponding to a period during which the supply of power to the paper-end detecting sensor 15 is stopped. On the other hand, the timing chart in part (B) of FIG. 4 also shows a high-level state and a low-level state, the high-level state corresponding to a period during which the PF motor 27 is driven and the low-level state corresponding to a period during which the driving of the PF motor 27 is stopped. Above the two timing charts are shown the cut paper P being transported from the right side of FIG. 4 corresponding to the upstream side towards the left side of FIG. 4 corresponding to the downstream side, the record head 28 that ejects ink droplets while reciprocating in a direction orthogonal to the transporting direction of the cut paper P, and the paper-end detecting sensor 15 that can detect whether the leading and trailing ends of the cut paper P have reached an end-detection position X.

As shown in parts (A) and (B) in FIG. 4, when it is detected that the leading end of the cut paper P has passed the end-detection position X, the supply of power to the light-emitting element 20 of the paper-end detecting sensor 15 is stopped, and the PF motor 27 starts to transport the cut paper P in an intermittent manner. In between the intermittent transporting motions of the cut paper P (corresponding to an interval), the record head 28 ejects ink droplets toward the cut paper P while moving in a reciprocating manner. The supply of power to the paper-end detecting sensor 15 resumes when the cut paper P is transported $N_1-n$ times repetitively by the PF motor 27, i.e. when the cut paper P is transported from position d0 to position d1. As the trailing end of the cut paper P reaches the end-detection position X through one or more subsequent transporting motions, the number $N_2$ of transporting motions required for shifting the rendering-image denotation section on the cut paper P to the ink-droplet ejecting position located upstream relative to the end-detection position X is determined. Upon completion of $N_2$ transporting motions, the record head 28 ejects ink droplets for forming a ruled line. As shown in FIG. 4, the distance from the rendering-image denotation section where the ruled line is required to the leading end of the cut paper P is significantly greater than the distance from the rendering-image denotation section to the trailing end. Consequently, rather than determining the recording timing of the ruled line on the basis of the number of transporting motions required for shifting the rendering-image denotation section on the cut paper P to the ink-droplet ejecting position after the leading end of the cut paper P reaches the end-detection position X, the ruled line can be positioned with higher accuracy by determining the recording timing of the ruled line on the basis of the number $N_2$ of transporting motions required for shifting the rendering-image denotation section on the cut paper P to the ink-droplet ejecting position after the trailing end of the cut paper P reaches the end-detection position X. Furthermore, the supply of power to the paper-end detecting sensor 15 is stopped from the point when the leading end of the cut paper P reaches the end-detection position d0 to the point of completion of $N_1$−n transporting motions. This ensures that a detection failure with respect to the trailing end of the cut paper P can be properly prevented while reducing wasteful consumption of power by the paper-end detecting sensor 15. With the reduced power consumption, deterioration of the paper-end detecting sensor 15 can be minimized, thereby extending the lifespan of the paper-end detecting sensor 15. To achieve these advantages, the paper transporting distance for each transporting motion of the cut paper P at least needs to be set smaller than the distance between the trailing end of the cut paper P and the rendering-image denotation section.

Sensor-Luminance Adjusting Process

Figure 5:
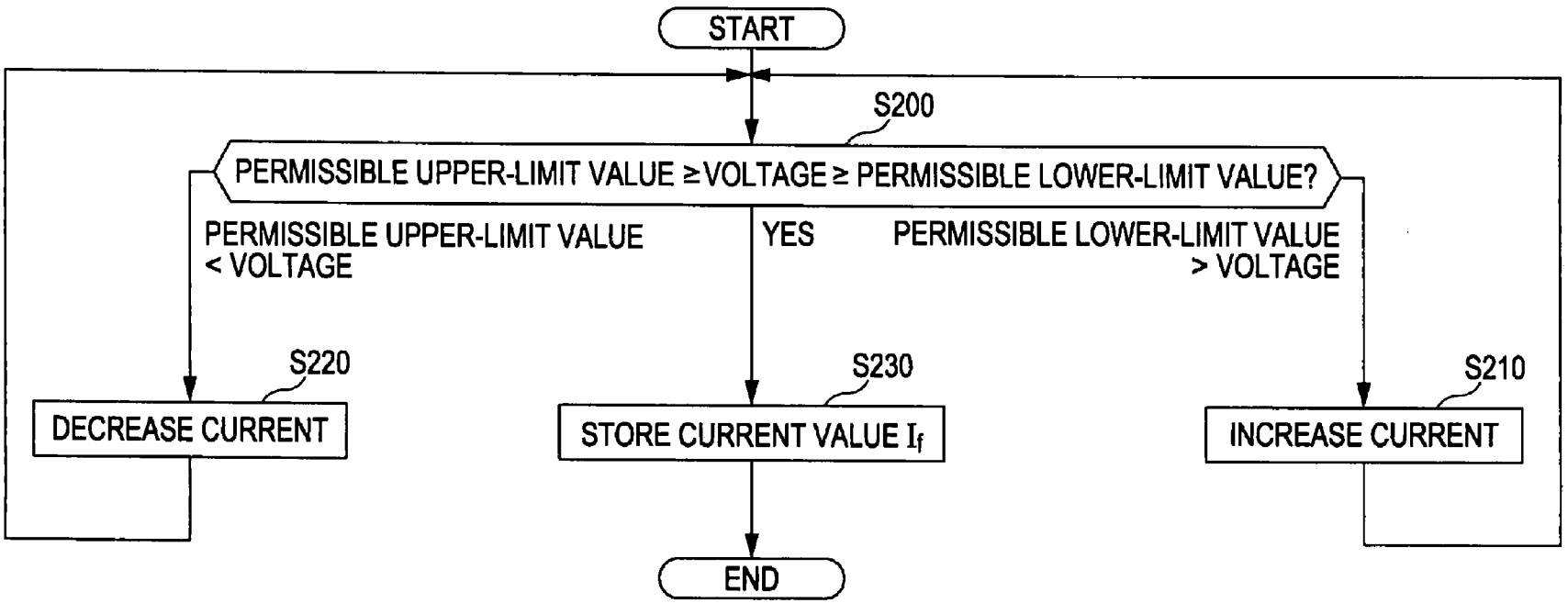
FIG. 5 is a flow chart showing a sensor-luminance adjusting process.

FIG. 5 is a flow chart showing a sensor-luminance adjusting process. A sensor-luminance adjusting process is intended for adjusting the intensity of light from the light-emitting element 20 to attain the sensitivity required and sufficient for detecting the trailing end of cut paper P on the basis of the intensity of reflected light received by the light-receiving element 21 when the leading end of the cut paper P reaches the end-detection position. This sensor-luminance adjusting process starts when the control unit 40 detects that the leading end of the cut paper P has been passed through the end-detection position by the user in the preparation process, namely, when the control unit 40 detects that the voltage of a signal output from the light-receiving element 21 of the paper-end detecting sensor 15 has fallen below the threshold value.

In step S200, the control unit 40 determines whether or not the voltage of the signal output from the light-receiving element 21 of the paper-end detecting sensor 15 is within a range between a preset permissible upper-limit value and a preset permissible lower-limit value. If it is determined in step S200 that the voltage of the signal output from the light-receiving element 21 of the paper-end detecting sensor 15 is below the permissible lower-limit value, the control unit 40 increases the electric current flowing into the light-emitting element 20 by a predetermined amount in step S210 and returns to step S200. As the electric current flowing into the light-emitting element 20 increases, the light emitted from the light-emitting element 20 towards the cut paper P increases in intensity accordingly. As a result, the quantity of light reflected by the cut paper P and subsequently received by the light-receiving element 21 also increases, whereby the voltage of a signal obtained as a result of photo-electrically converting the reflected light increases. Therefore, every time step S210 is performed, the voltage of the signal output from the light-receiving element 21 is increased by a predetermined amount towards the permissible lower-limit value, and until the voltage becomes higher than or equal to the permissible lower-limit value, the loop for returning to step S200 from step S210 is repeated.

If it is determined in step S200 that the voltage of the signal output from the light-receiving element 21 of the paper-end detecting sensor 15 is above the permissible upper-limit value, the control unit 40 decreases the electric current flowing into the light-emitting element 20 of the paper-end detecting sensor 15 by a predetermined amount in step S220 and returns to step S200. As the electric current flowing into the light-emitting element 20 decreases, the light emitted from the light-emitting element 20 towards the cut paper P decreases in intensity accordingly. As a result, the quantity of light reflected by the cut paper P and subsequently received by the light-receiving element 21 also decreases, whereby the voltage of a signal obtained as a result of photo-electrically converting the reflected light decreases. Therefore, every time step S220 is performed, the voltage of the signal output from the light-receiving element 21 is decreased by a predetermined amount towards the permissible upper-limit value, and until the voltage becomes lower than or equal to the permissible upper-limit value, the loop for returning to step S200 from step S220 is repeated. When it is determined in step S200 that the voltage of the signal output from the light-receiving element 21 of the paper-end detecting sensor 15 is within the range between the preset permissible upper-limit value and the preset permissible lower-limit value (YES in step S200), the control unit 40 stores the current value $I_f$ of the electric current flowing into the light-emitting element 20 at the time of the determination in a predetermined area of the EEPROM 48 in step S230. Finally, the process ends.

The series of steps in the sensor-luminance adjusting process described above is performed prior to the reception of print data shown in step S100 in FIG. 3. Furthermore, when power is to be supplied to the paper-end detection sensor 15 in step S150 in FIG. 3, the power is adjusted such that the electric current flowing into the light-emitting element 20 becomes equal to the current value $I_f$. Due to this adjustment, the passing of the trailing end of the cut paper P can be detected with high accuracy without being affected by differences in the material of the paper used.

Figure 6:
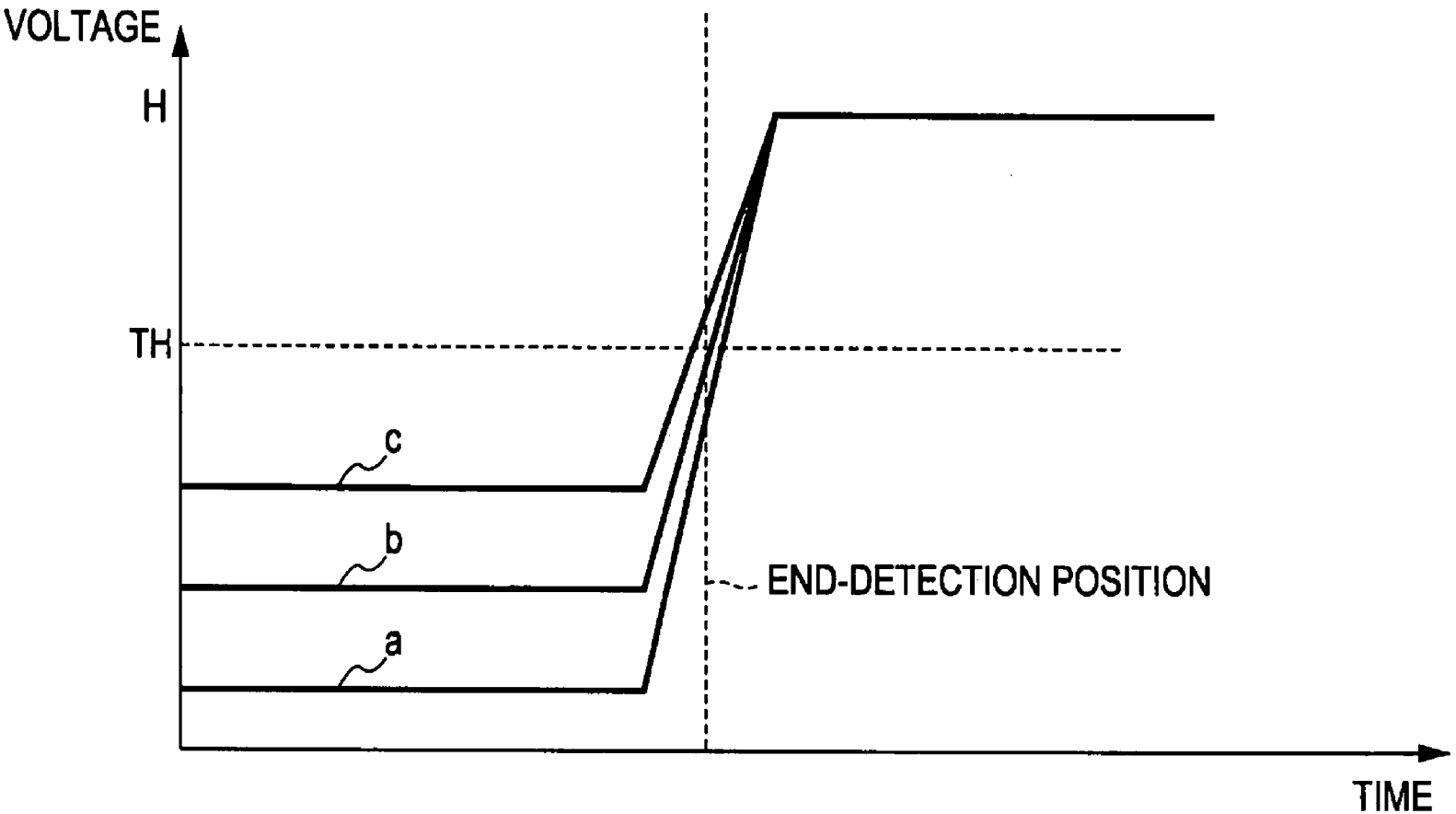
FIG. 6 is a graph that compares changes in the voltage of a signal output from a light-receiving element before and after the trailing end of cut paper reaches a end-detection position with respect to the reflectivity of three different kinds of paper.

The principle of this sensor-luminance adjusting process will be described in detail below with reference to FIG. 6. FIG. 6 is a graph that compares the changes in the voltage of the signal output from the light-receiving element 21 before and after the trailing end of cut paper P reaches the end-detection position with respect to the reflectivity of three different kinds of paper. Specifically, in FIG. 6, wave b denotes a change in the voltage occurring upon detection of the trailing end of so-called coated paper, wave a denotes a change in the voltage occurring upon detection of the trailing end of paper (such as art paper) that is made of a material having higher reflectivity than that of coated paper, and wave c denotes a change in the voltage occurring upon detection of the trailing end of paper (such as high-quality paper) made of a material having lower reflectivity than that of coated paper. It is to be noted that the intensity of light emitted from the light-emitting element 20 is the same among these waves.

As shown in FIG. 6, when the trailing end of the cut paper P reaches the end-detection position, the voltage of the signal output from the light-receiving element 21 increases drastically from a low level state. The reason why the voltage is held at a low level until the trailing end of the cut paper P reaches the end-detection position is that, before the light emitted from the light-emitting element 20 is received by the light-receiving element 21, the light is blocked and reflected by the cut paper P without being able to reach the bottom of the recess 19. As the trailing end of the cut paper P passes through the end-detection position, the light emitted from the light-emitting element 20 can now reach the bottom of the recess 19 and the reflection of that light is received by the light-receiving element 21. As a result, the voltage increases. Accordingly, while the trailing end of the cut paper P is still positioned upstream relative to the end-detection position, the voltage is lower for waves that correspond to papers with higher reflectivity. On the other hand, after the trailing end passes through the end-detection position, the voltage becomes the same among all of the waves.

As described above, the control unit 40 determines that the trailing end of the cut paper P has reached the end-detection position when the voltage of the signal output from the light-receiving element 21 exceeds the preset threshold value. However, when an intermediate voltage value TH between a bottom voltage value L and a peak voltage value H in wave b is set as the threshold value, if the cut-paper CAD printing process shown in FIG. 3 is performed without implementing any treatments, the positioning accuracy of the rendering-image denotation section may unfavorably vary among the waves shown in FIG. 6 due to the following reasons. Specifically, if the cut paper P being transported is made of a material that induces a voltage change as shown by wave a, the voltage would overpass the voltage value TH at a later time with respect to that in wave b. If the cut paper P being transported is made of a material that induces a voltage change as shown by wave c, the voltage would overpass the voltage value TH at an earlier time with respect to that in wave b. In contrast, with the series of steps in the sensor-luminance adjusting process performed prior to the reception of print data shown in step S100 in FIG. 3, the intensity of light from the light-emitting element 20 can be favorably adjusted such that the changes in the voltage of the signal output from the light-receiving element 21 before and after the trailing end of cut paper P reaches the end-detection position are converged with the change in the voltage shown by wave b. In other words, the differences in the material of cut paper P can be compensated for through the sensor-luminance adjusting process, thereby preventing variations in the positioning accuracy of the rendering-image denotation section.

Other Embodiments

Various modifications are permissible in the invention.

In the printer according to the above embodiment, the paper-end detecting sensor 15 is defined by a reflective photo-interrupter in which the light-emitting element 20 arranged to emit light towards the end-detection position and the light-receiving element 21 arranged to receive the light from the end-detection position are disposed in a side-by-side fashion. Alternatively, the paper-end detecting sensor 15 may be defined by a transmissive photo-interrupter in which the light-emitting element 20 and the light-receiving element 21 are disposed facing each other.

Furthermore, in the printer according to the above embodiment, the pair of PF rollers 16 are defined by the driving PF roller 24 that rotates in response to a force received from the PF motor 27 and the driven PF roller 23 that rotates in conjunction with the driving PF roller 24, the two rollers 24 and 23 being supported such that the roller 24 is capable of being moved into and out of contact with the driven PF roller 23. Alternatively, the two rollers 24 and 23 may be configured to be rotated individually in response to forces received from separate motors while the two roller 24 is capable of being moved into and out of contact with the roller 23. As a further alternative, the driven PF roller 23 and the driving PF roller 24 may both be configured to be movable into contact with each other instead of only the driving PF roller being moved by the actuator 26.

Furthermore, the intermittent supply of power to the light-emitting element 20 may also be implemented before the cut paper P reaches position d1 in FIG. 4 such that the light-emitting element 20 is made to emit light when the PF motor 27 is driven and not to emit light when the PF motor 27 is stopped.

The entire disclosure of Japanese Patent Application No. 2007-225316, filed Aug. 31, 2007 is expressly incorporated by reference herein.

What is claimed is:

1. A liquid ejecting apparatus comprising:

a record head having nozzles that discharge liquid;

a transporting path along which a medium is transported;

a transporting mechanism that transports the medium along the transporting path;

a sensor including a light-emitting element and a light-receiving element and disposed at a first position on the transporting path, the first position being located upstream relative to the record head in a transporting direction of the medium, the sensor outputting a signal in accordance with presence or absence of the medium at the first position; and a control unit that controls supply of power to the sensor and detects the presence or absence of the medium through the sensor, wherein the control unit stops the supply of power to the sensor when the control unit detects a downstream end of the medium in the transporting direction, and resumes the supply of power to the sensor when the control unit detects an upstream end of the medium in the transporting direction.

2. A liquid ejecting apparatus comprising:

a record head having nozzles that discharge liquid;

a transporting path along which a medium is transported;

an image obtaining unit that obtains an image signal designating an image;

a transporting mechanism that intermittently transports the medium along the transporting path;

a sensor including a light-emitting element and a light-receiving element and disposed at a first position on the transporting path, the first position being located upstream relative to the record head in a transporting direction of the medium, the sensor outputting a signal in accordance with presence or absence of the medium at the first position; and a control unit that controls supply of power to the sensor and detects the presence or absence of the medium through the sensor, wherein the control unit stops the supply of power to the sensor when the control unit detects that a downstream end of the medium in the transporting direction has reached the first position, allows the medium to be transported intermittently by a predetermined number of times determined based on the image signal, and resumes the supply of power to the sensor before an upstream end of the medium in the transporting direction reaches the first position.

3. The liquid ejecting apparatus according to claim 2, wherein the control unit determines a position of the upstream end of the medium when the control unit detects the upstream end of the medium, and designates a section located downstream from the upstream end by a predetermined distance as a recording position for a downstream frame line in the transporting direction to be recorded on the medium, the downstream frame line being one of a plurality of frame lines to be recorded on the medium, the frame lines corresponding to edges of the medium.

4. The liquid ejecting apparatus according to claim 2, wherein after the control unit detects the downstream end of the medium, the control unit supplies power to the sensor while the medium is transported by the transporting mechanism, but stops the supply of power to the sensor while the transporting of the medium is stopped.

5. The liquid ejecting apparatus according to claim 2, wherein the control unit adjusts an amount of power supplied to the light-emitting element on the basis of an output level of a signal output from the light-receiving element when the medium is present at the first position.

6. The liquid ejecting apparatus according to claim 5, wherein the control unit determines whether the output level of the signal is within a predetermined range between a permissible upper-limit value and a permissible lower-limit value, and increases or decreases the amount of power supplied to the light-emitting element so as to adjust the output level of the signal to within the predetermined range.

7. The liquid ejecting apparatus according to claim 2, wherein the medium on which recording is performed has an A0, A1, or A2 size.

* * * * *